US005437382A

United States Patent [19]

Gluckman

[11] Patent Number: 5,437,382

[45] Date of Patent: Aug. 1, 1995

[54] SAFETY LOCK PILL CONTAINER

[76] Inventor: Jerome D. Gluckman, Apt. 713S, 666 W. Germantown Pike, Plymouth Meeting, Pa. 19462

[21] Appl. No.: 316,594

[22] Filed: Sep. 30, 1994

[51] Int. Cl.[6] ..... B65D 17/52; B65D 51/18; B65D 55/02

[52] U.S. Cl. ..... 215/204; 215/215; 215/228; 215/302; 220/284

[58] Field of Search ..... 215/204, 215, 302, 303, 215/228; 220/212, 212.5, 284

[56] References Cited

U.S. PATENT DOCUMENTS

| | | | |
|---|---|---|---|
| Re. 28,861 | 6/1976 | Hall, Jr. | 215/204 |
| 441,240 | 11/1990 | Guptill . | |
| 1,416,616 | 5/1922 | Crane . | |
| 2,921,705 | 1/1960 | Dorsey | 215/9 |
| 3,044,648 | 7/1962 | Cohn | 215/9 |
| 3,157,302 | 11/1964 | Hakim | 215/9 |
| 3,164,277 | 1/1965 | Reading | 215/9 |
| 3,181,718 | 5/1965 | Chancellor | 215/9 |
| 3,265,233 | 8/1966 | Tuuri | 215/9 |
| 3,269,576 | 8/1966 | Law | 215/43 |
| 3,276,612 | 10/1966 | Caldwell | 215/9 |
| 3,394,830 | 7/1968 | Schiavo | 215/9 |
| 3,396,864 | 8/1968 | Jones et al. | 215/9 |
| 3,409,159 | 11/1968 | Velt | 215/9 |
| 3,473,681 | 10/1969 | Hall, Jr. | 215/204 |
| 3,480,170 | 11/1969 | Evans et al. | 215/43 |
| 3,578,193 | 5/1971 | Steiner | 215/47 |
| 3,625,387 | 12/1971 | Schaefer | 215/9 |
| 3,684,115 | 8/1972 | Birch | 215/9 |
| 3,737,063 | 6/1973 | Loup | 215/9 |
| 3,744,654 | 7/1973 | Bromberg | 215/9 |
| 3,756,445 | 9/1973 | Hedgewick | 215/9 |
| 3,800,987 | 4/1974 | Kemp | 222/153 |
| 3,820,675 | 5/1974 | Malles | 215/9 |
| 3,841,513 | 10/1974 | O'Conner et al. | 215/9 |
| 4,098,417 | 7/1978 | Bennett | 215/204 |
| 4,159,780 | 7/1979 | Romaine | 215/215 |
| 4,223,799 | 9/1980 | Eyster et al. | 220/230 |
| 4,382,512 | 5/1983 | Furminger | 206/446 |
| 4,469,235 | 9/1984 | Parker | 215/295 |
| 4,496,065 | 1/1985 | Nagy | 215/207 |
| 4,526,281 | 7/1985 | Herr | 215/211 |
| 4,526,283 | 7/1985 | Skinner | 215/256 |
| 4,579,247 | 4/1986 | Hasui et al. | 220/288 |
| 4,609,121 | 9/1986 | Ludwig | 220/234 |
| 4,688,703 | 8/1987 | Bayer | 222/541 |
| 4,705,181 | 11/1987 | Burke et al. | 215/220 |
| 4,731,512 | 3/1988 | Barriac | 215/220 |
| 4,775,061 | 10/1988 | Coote | 215/215 |
| 4,830,206 | 5/1989 | Fisher | 215/209 |
| 5,158,194 | 10/1992 | Sirgo et al. | 215/219 |
| 5,213,225 | 5/1993 | King et al. | 215/330 |

FOREIGN PATENT DOCUMENTS

| | | |
|---|---|---|
| 197807 | 7/1978 | France . |
| 197810 | 10/1978 | Germany . |

*Primary Examiner*—Stephen J. Castellano
*Assistant Examiner*—Nathan J. Newhouse
*Attorney, Agent, or Firm*—Seidel Gonda Lavorgna & Monaco

[57] ABSTRACT

A container having a removable stopper located within the neck of the container and a cap with a handle disposed over the neck. The cap, when removed and inverted, also functions as a tool or driver for removing the stopper. The handle assists persons with impaired dexterity in opening the container, and while a child may likewise remove the cap, the contents cannot be accessed and will not spill out because the stopper is still disposed in the neck. Further, the stopper being disposed within the neck places it out of the grasping ability of the child making it very difficult to remove without using the handle as a tool. The cap also has a tab or tabs on its inside, so that when the cap is removed and inverted, the previously external handle or tab is used as the driver blade and the previously internal tab or tabs are used as a driver handle.

16 Claims, 2 Drawing Sheets

SAFETY LOCK PILL CONTAINER

The invention relates to containers having safety caps and, more specifically, to an improved container assembly which includes an internal safety stopper and a cap means for removing the same.

BACKGROUND OF THE INVENTION

Safety closures on bottles and other types of containers are intended to prevent young children from readily gaining access to potentially hazardous contents of the containers. In the pharmaceutical field, for example, the use of child safety caps on drug containers is quite extensive.

A common type of safety closure requires that a downward pressure be applied to the cap while, simultaneously, twisting the same. The primary deficiency with safety closures of this type is that they are difficult for the elderly and the infirm to operate. In particular, persons who suffer from arthritis have difficulty grasping the cap and twisting with downward pressure.

Another common safety closure requires rotating the cap until it is aligned with a particular point on the container, where it can then be pushed off the container with the thumb. This procedure is difficult for persons with diminished vision or impaired dexterity.

Packaging which is intended to be easily opened by the arthritic or infirm further exacerbates the problem. U.S. Pat. No. 5,213,225 discloses a container and cap assembly which provides for relatively easy removal of the cap by persons with impaired dexterity. The cap and container have threads arranged to permit complete engagement and disengagement of the cap with only a 90° twist. The cap includes a large planar handle which extends vertically upward. The handle is simpler to grasp and provides more leverage then the cap itself, thereby providing persons with arthritic conditions an easier mechanism for opening the container. The handle also has a hole therethrough permitting a pencil to be inserted and used as a lever, if needed, for increased torque. Unfortunately, the handle not only makes the container just as easy for young children to open, it also makes the container more appealing as a play object and attracts the child to turn the handle.

A need therefore exists for a container with a safety cap which provides for ease of removal of the cap yet minimizes the ability of a child to readily gain access to the contents of the container.

SUMMARY OF THE INVENTION

This need is satisfied by a container having a removable stopper disposed within the neck of the container and a cap with handle disposed over the neck. After the cap is removed, it can be inverted to use the cap handle as a tool for removing the stopper. The handle assists persons with impaired dexterity in opening the container, and while a child may likewise remove the cap, the contents will not spill out because the stopper is still disposed in the neck. Further, the stopper being disposed within the neck places it out of the grasping ability of the child, and makes it very difficult to remove without using the handle as a tool. A child having sufficiently developed cognition to immediately associate the handle as a tool for removing the stopper would likely also be developed enough to be told and understand that the contents of the container can be hazardous, and that he or she should not open the container.

Yet an adult, even with diminished vision or impaired dexterity, would find the tool mechanism easy to engage with and remove the stopper.

In the embodiment described herein, the stopper is a disc attached inside the neck of the container by a set of screw threads, and has a slot across its upper face. The handle is a flat tab which projects vertically from the cap, and fits into the slot as the blade of a driver. The cap also has a tab or tabs on its inside, so that when the cap is removed and inverted, the previously external handle or tab is used as the driver blade and the previously internal tab or tabs are used as a driver handle.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE CONTAINER

Figure 1:
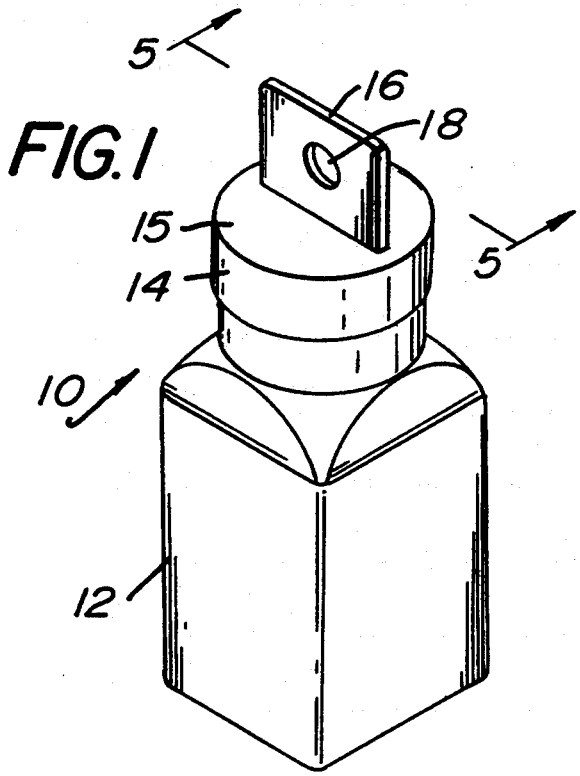
FIG. 1 is a perspective view of the container according to the present invention with the cap in a first position.

Referring now to the drawings, wherein like reference numerals illustrate corresponding or similar elements, FIG. 1 shows a container 10 which includes a container body 12 and a cap 14. The shape and size of the container body 12 are not significant to the invention, so the body may be of any appropriate type having a cavity formed therein for holding pharmaceutical products or other small items or liquid. In FIG. 1, the cap 14 is shown disposed on and removably attached to the container body 12. For purposes of describing the operation of the container, this position is referred to as the cap's "first position".

The cap has an upper surface 15, which is substantially fiat, and a first tab 16 which extends upward from the cap. The first tab 16 is used as a handle to provide a surface which is larger and more easily grasped than the annular side wall of the cap, so a person can apply sufficient torque to rotate the cap. In this embodiment, the first tab 16 is a vertically projecting fiat tab member which is formed as an integral extension of the upper surface 15 of the cap. When the cap 14 is in the first position, the first tab 16 is outside the container. The first tab 16 includes a hole 18 formed therethrough which provides a mechanism to hang the container 10 for display purposes, and which can also be used to receive a pencil or similar type implement for providing increased leverage.

Figure 2:
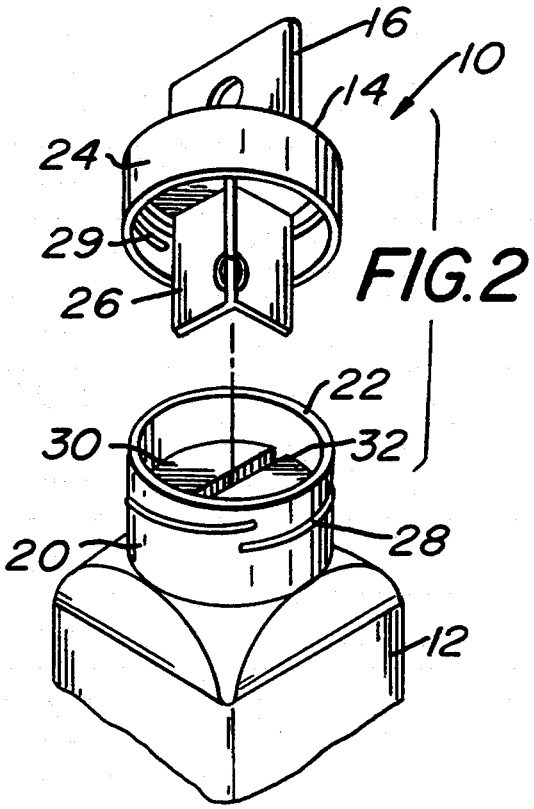
FIG. 2 illustrates the container according to the present invention with the cap removed from the container body.

Referring now to FIG. 2, the container body 12 includes a neck portion 20 to which the cap 14 is removably attached when the cap 14 is in the first position. The neck portion 20 has an circular opening 22 formed therein which provides for passage of the contents into and out of the container body 12. The opening 22 has a tapered segment 23 wherein the diameter of the opening reduces, and which contains threads to engage a stopper, as described below.

The cap 14 includes an annular side wall 24 which projects downward when the cap is in the first position, so as to be situated about the container's neck portion 20, as shown in FIG. 1. The cap 14 also includes a second tab 26, which is positioned within the annular side wall 24 and which extends downward from the cap in the same direction as the annular side wall 24 and opposite from the first tab 16. The second tab 26 has a sufficient length to project beyond the downward projection of the annular side wall 24, and a sufficient width to fit within the opening 22 of the neck portion 20, as can clearly be seen in FIG. 2. The second tab 26 includes at least one vertically projecting flat tab member; that is, it could be a single flat tab member essentially identical to the first tab 16. In the embodiment shown in FIG. 2, the second tab 26 comprises three vertically projecting flat tab members which are radially aligned and equally spaced from each other. The second tab 26 may be formed as an integral extension of the cap 14. When the cap 14 is in the first position, the second tab 26 projects downward into the container's neck.

In this embodiment, the cap 14 is engaged with the neck portion 20 through a threaded arrangement. The neck portion 20 has external threads 28 formed thereon which engage with corresponding internal threads 29 formed on the annular side wall 24 of the cap 14.

Figure 5:
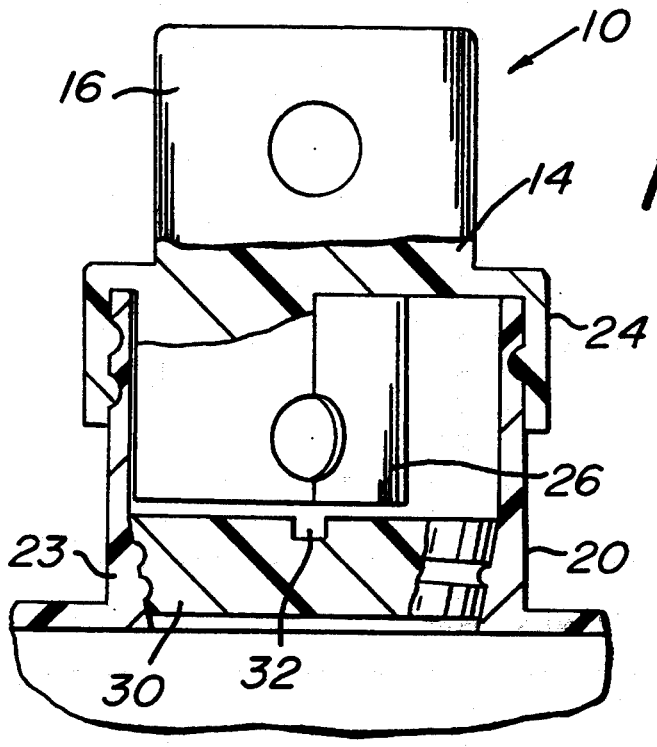
FIG. 5 is a detail section view of the container according to the present invention taken along line 5—5 in FIG. 1, and illustrating the cap in a first position on the neck portion of the container body.

A stopper 30 is removably mounted within the tapered section 23 of the neck opening 22 of the container body 12, and functions as a safety device. The stopper 30 has a recessed slot 32 formed therein. The height of the second tab 26 is sufficient so that it will not engage with the slot 32 when the cap 14 is in the first position and the stopper 30 is screwed into the tapered section of the neck opening. FIG. 5 more clearly illustrates the configuration of the cap 14 and neck portion 20. The second tab 26 extends down into the neck portion 20 but terminates above the stopper 30, such that the second tab does not engage with the slot 32.

Figure 3:
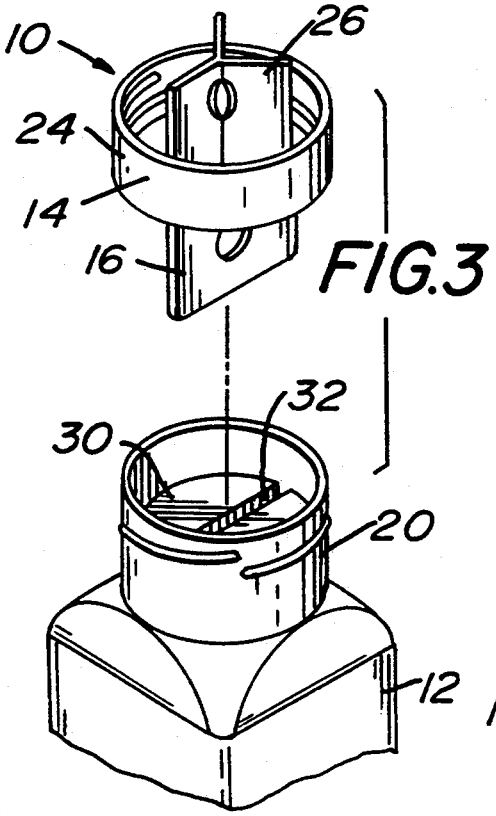
FIG. 3 illustrates the container according to the present invention with the cap in an inverted position.

In FIG. 3, the cap 14 is shown in an inverted position, with the first tab 16 pointing in a downward direction and the second tab 26 and the annular side wall 24 both projecting in an upward direction. The slot 2 is configured to accept the first tab 16. For example, in the preferred embodiment illustrated, the slot 32 is formed as a single recess in the stopper 30. The slot is designed to engage with the single flat tab member which comprises the first tab 16. That is, the first tab 16 has a length sufficient to engage with the slot 32 of the stopper 30 when the cap is in the second position.

Figure 4:
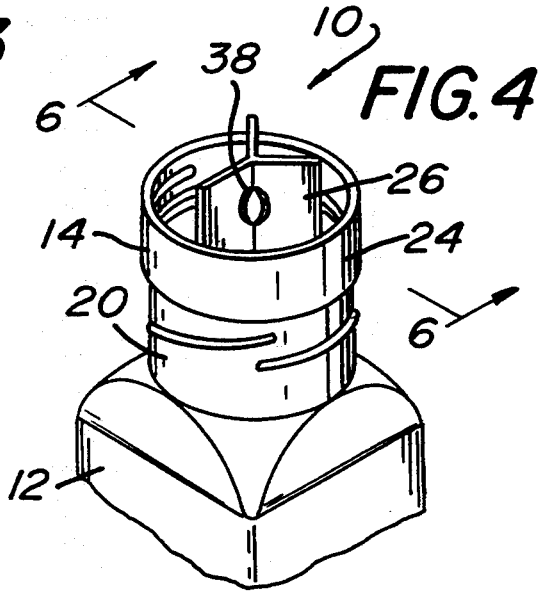
FIG. 4 illustrates the container according to the present invention with the cap in a second position.

Referring now to FIG. 4, the cap 14 is shown in a second position whereupon the inverted cap 14 is disposed on the container body 12. The second tab 26 and the annular side wall 24 project in an upward direction and the first tab 16 projects downward into the container neck.

Figure 6:
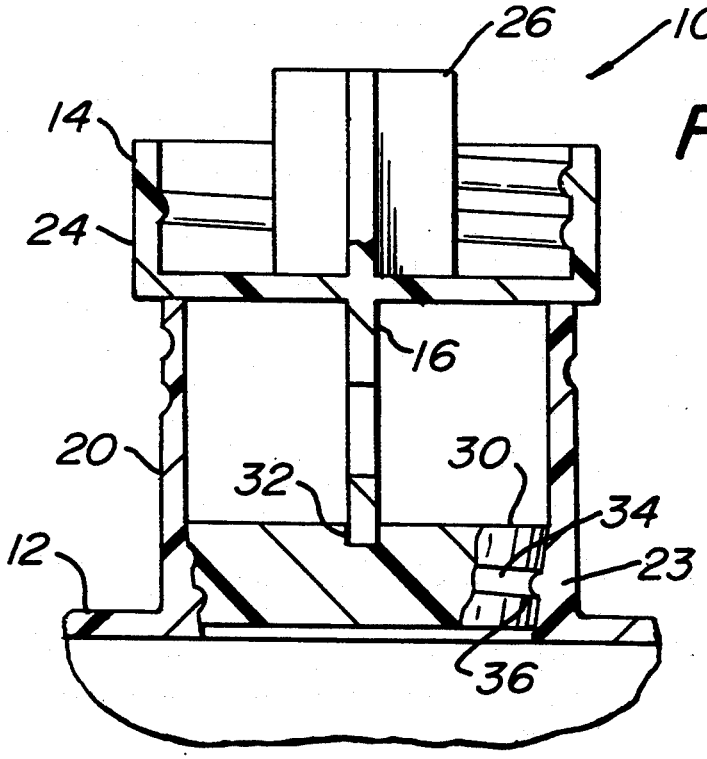
FIG. 6 is a detail section view of the container according to the present invention taken along line 6—6 in FIG. 4, and illustrating the cap in a second position on the neck portion of the container body.

The first tab 16 engages with the slot 32 when the cap is in the second position, as seen in FIG. 6. The first tab 16 has a width sufficient to fit within the opening 22. When so positioned the first tab 16 serves as driver blade in the slot 32 for engaging and disengaging the stopper 30. Hence, when the cap 14 is rotated while in the second position, the first tab 16, acting in conjunction with the slot 32, causes the stopper 30 to rotate and thread the stopper into either engagement or disengagement with respect to the neck 20.

The second tab 26 is used as a driver handle to rotate the cap. The three vertical tab members, which comprise the second tab 26 in the preferred embodiment, aid in rotating the cap 14 by providing comfortably located surfaces upon which to apply a load to torque the cap 14. To make rotating the cap 14 easier in the second position, the second tab 26 has a tab hole 38 formed therethrough, shown in FIG. 4, which is similar to the tab hole 18 in the first tab 16. An implement such as a pencil may be placed through the hole to provide increased leverage by increasing the moment arm of the applied torque.

When turned in the proper direction, the rotation of the cap 14 causes the threads on the stopper 30 and the neck portion 20 to disengage, thereby disengaging the safety device. The stopper may then be removed and the items contained within the container 10 readily accessed. The stopper 30 may be replaced by reversing the rotation of the inverted cap 14, with respect to the container body 12.

It should be apparent that if the safety feature is not desired it may be removed by first following the steps outlined above for accessing the contents of the container. The stopper 30 may then be discarded or placed in a location from where it may be retrieved if needed at a later time.

Although the invention has been described and illustrated with respect to the embodiment thereof, it should be understood by those skilled in the art that the foregoing and various other changes, omissions and additions may be made therein and thereto, without departing from the spirit and scope of the present invention.

What is claimed:

1. A container comprising:

a container body defining a cavity for holding pharmaceutical items, the container body including a neck which has an opening formed therein;

a stopper removably disposed within and attached to the neck and having a recess formed therein;

a removable cap comprising:

an annular side wall which is positioned about the neck portion and projects downward along the neck when the cap is in a first position in which it is disposed on and attached to the neck, a first tab which extends upward from the cap when the cap is disposed on and attached to the neck, a second tab extending downward from the cap when the cap is disposed on and attached to the neck, the second tab being located within the annular side wall, and including at least one vertically projecting substantially flat tab member having a width dimension which is less than the opening in the neck portion and having a height of sufficient dimension so as not to engage with the recess in the stopper when the cap is disposed on and attached to the neck portion in the first position; and said first tab adapted to be engaged with the recess in the stopper when the cap is removed from being disposed on and attached to the neck, such that the cap may be used in a second position as a tool to remove the stopper from the neck.

2. A container as in claim 1, wherein the first tab comprises at least one vertically-projecting flat tab member having a width dimension which is less than the opening in the neck portion, and having a height of sufficient dimension so as to engage with the recess in the stopper when the cap is in the second position.

3. A container as in claim 1, wherein the first tab is one vertically projecting substantially flat tab member, and wherein the second tab is three vertically projecting substantially flat tab members radially aligned and equally spaced from one another.

4. A container as in claim 2, wherein the first tab is an integral extension of the cap.

5. A container as in claim 2, wherein the first tab has a hole formed therethrough for receiving an implement which facilitates removal of the cap from the container body.

6. A container as in claim 1, wherein the second tab has a hole formed therethrough for receiving an implement which facilitates removal of the cap from the container body.

7. A container as in claim 1, wherein the cap is attached to the neck portion of the container body by a set of threads comprising an internal thread formed on the cap and an external thread formed on the neck portion.

8. A container as in claim 2, wherein the stopper is attached to the neck portion of the container body by a set of threads comprising an internal thread formed on the neck portion and an external thread formed on the stopper.

9. A container as in claim 8, wherein in the cap is used as a driver in said second position to rotate the stopper such that said threads move the stopper out of the neck.

10. A container as in claim 1, wherein the first tab is one vertically projecting flat tab member, and wherein the second tab is three vertically projecting flat tab members radially aligned and equally spaced from one another, such that the first tab serves as the driver's blade and the second tab serves as the driver's handle.

11. An improved container including a cap and a container body, the cap being removably attached to the container body, wherein the improvement comprises:

the cap having a first position and a second position, the cap being attached to the container body in the first position and being disposed on the container body in the second position;

at least one upwardly projecting tab extending from the cap for facilitating removal of the cap from the container body when the cap is in the first position;

at least one downwardly projecting tab extending from the cap into the container body when the cap is in the first position;

at least one upwardly projecting tab extending from the cap for facilitating rotation of the same when the cap is in the second position, the cap being in an inverted position from the first position when in the second position;

a safety device attached to and located within the container body and preventing access to the items container therein;

means operative in the second position for engaging and disengaging said safety device;

wherein the at least one downwardly projecting tab in the first position has a height dimension so as not to engage with the safety device when the cap is in the first position; and wherein the means operative in the second position comprises said at least one upwardly projecting tab in the first position interacting with the safety device when the cap is in the second position.

12. A container as in claim 11, wherein the safety device comprises a stopper, and wherein the means operative in the second position comprises said at least one upwardly projecting tab in the first position interacting with a recess formed in the stopper for engaging and disengaging the stopper from the container body.

13. An improved container including a cap and a container body, the cap being removably attached to the container body, wherein the improvement comprises:

the cap having a first position and a second position, the cap being attached to the container body in the first position and being disposed on the container body in the second position;

at least one upwardly projecting tab extending from the cap for facilitating removal of the cap from the container body when the cap is in the first position;

at least one upwardly projecting tab extending from the cap for facilitating rotation of the same when the cap is in the second position, the cap being in an inverted position from the first position when in the second position;

a safety device attached to the container body and preventing access to the items container therein;

means operative in the second position for engaging and disengaging said safety device;

wherein the safety device comprises a stopper, and wherein the means operative in the second position comprises said at least one upwardly projecting tab in the first position interacting with a recess formed in the stopper for engaging and disengaging the stopper from the container body; and wherein said at least one upwardly projecting tab extending from the cap in the second position is three flat tab members radially aligned and equally spaced from one another, the flat tab members being configured so as to fit within a portion of the container body when the cap is in the first position, and wherein said at least one upwardly projecting tab extending from the cap in the first position is an integral extension of the cap.

14. A method for opening a child safety container, the container including a cap, a container body and a stopper mounted within a neck portion of the container body, comprising the steps of:

(a) rotating the cap with respect to the container body by applying a load to a first substantially flat tab which projects upward from the cap, thereby causing a substantially flat second tab positioned within the container and attached to the cap to rotate with respect to the stopper without engaging the stopper;

(b) removing the cap;

(c) inverting the cap;

(d) engaging the first tab with a slotted recess formed in the stopper;

(e) rotating the cap with respect to the container body by applying a load to the second tab which projects upward from the inverted cap; and (f) removing the stopper from the neck portion of the container body.

15. A container comprising:

a container body defining a cavity for holding items, the container body including a neck which has an opening formed therein;

a stopper removably disposed within and attached to the neck and having a recess formed therein;

a removable cap comprising:

an annular side wall which is positioned about the neck portion and projects downward along the neck when the cap is in a first position in which it is disposed on and attached to the neck, a first tab which extends upward from the cap when the cap is disposed on and attached to the neck, a second tab extending downward from the cap when the cap is disposed on and attached to the neck, the second tab being located within the annular side wall, the second tab having a width dimension which is less than the opening in the neck portion and having a height of sufficient dimension so as not to engage with the recess in the stopper when the cap is disposed on and attached to the neck portion in the first position; and said first tab adapted to be engaged with the recess in the stopper when the cap is removed from being disposed on and attached to the neck, such that the cap may be used in a second position as a tool to remove the stopper from the neck, and wherein said second tab facilitates rotation of the cap when the cap is in the second position.

16. A container comprising:

a container body defining a cavity for holding items, the container body including a neck which has an opening formed therein;

a stopper removably disposed within and attached to the neck by a set of threads comprising an internal thread formed on the neck portion and an external thread formed on the stopper and having a recess formed therein;

a removable cap comprising:

an annular side wall which is positioned about the neck portion and projects downward along the neck when the cap is in a first position in which it is disposed on and attached to the neck, a first tab which extends upward from the cap when the cap is disposed on and attached to the neck, the first tab comprising one vertically-projecting flat tab member, a second tab extending downward from the cap when the cap is disposed on and attached to the neck, the second tab being located within the annular side wall and comprising three vertically projecting flat tab members radially aligned and equally spaced from one another; and said first tab adapted to be engaged with the recess in the stopper when the cap is removed from being disposed on and attached to the neck, such that the cap may be used in a second position as a driver with the first tab serving as the driver's blade and the second tab serving as the driver's handle to rotate the stopper such that the threads move the stopper out of the neck, and wherein said second tabs are adapted to be grasped by a person's fingers when in the second position to facilitate rotation of the cap.

* * * * *